US011891875B2

(12) United States Patent
Duggan

(10) Patent No.: US 11,891,875 B2
(45) Date of Patent: Feb. 6, 2024

(54) EXPANDABLE ANNULAR SEAL TOOL AND SYSTEM

(71) Applicant: Andrew Duggan, Meadows Place, TX (US)

(72) Inventor: Andrew Duggan, Meadows Place, TX (US)

(73) Assignee: BAKER HUGHES OILFIELD OPERATIONS, Houston, TX (US)

( * ) Notice: Subject to any disclaimer, the term of this patent is extended or adjusted under 35 U.S.C. 154(b) by 34 days.

(21) Appl. No.: 17/852,534

(22) Filed: Jun. 29, 2022

(65) Prior Publication Data

US 2024/0003216 A1 Jan. 4, 2024

(51) Int. Cl.

| | |
|---|---|
| ***E21B 33/12*** | (2006.01) |
| ***E21B 23/01*** | (2006.01) |
| ***E21B 33/129*** | (2006.01) |

(52) U.S. Cl.

CPC ..... *E21B 33/1212* (2013.01); *E21B 23/01* (2013.01); *E21B 33/129* (2013.01); *E21B 2200/08* (2020.05)

(58) Field of Classification Search

CPC ..... E21B 33/128; E21B 33/1208; E21B 33/1212; E21B 23/01; E21B 33/129

See application file for complete search history.

(56) References Cited

U.S. PATENT DOCUMENTS

| | | | | |
|---|---|---|---|---|
| 10,794,132 | B2 * | 10/2020 | Mhaskar | E21B 23/06 |
| 10,808,507 | B2 * | 10/2020 | Burke | E21B 33/1212 |
| 11,248,436 | B2 * | 2/2022 | Graham | E21B 33/134 |
| 11,293,244 | B2 * | 4/2022 | Mhaskar | E21B 23/01 |
| 11,365,600 | B2 * | 6/2022 | Greenlee | E21B 33/134 |
| 11,459,850 | B2 * | 10/2022 | Power | E21B 33/134 |
| 2014/0262214 | A1 * | 9/2014 | Mhaskar | E21B 23/01 156/60 |
| 2017/0044859 | A1 * | 2/2017 | Blair | E21B 23/06 |
| 2019/0070803 | A1 * | 3/2019 | Rocheblave | B62D 29/004 |
| 2021/0332661 | A1 * | 10/2021 | Tonti | E21B 23/01 |
| 2021/0404285 | A1 * | 12/2021 | Reyes Villegas | E21B 33/1292 |
| 2022/0259938 | A1 * | 8/2022 | Guidry | E21B 33/043 |

FOREIGN PATENT DOCUMENTS

WO 2016018529 A1 2/2016

* cited by examiner

*Primary Examiner* — Nicole Coy

(74) *Attorney, Agent, or Firm* — CANTOR COLBURN LLP

(57) ABSTRACT

An expandable annular seal tool including a cone having an actuation surface, a seal member disposed in the actuation surface, and an annular seal element disposed on the actuation surface. An embodiment of a borehole system including a borehole in a subsurface formation, and a tool disposed in the borehole.

16 Claims, 7 Drawing Sheets

EXPANDABLE ANNULAR SEAL TOOL AND SYSTEM

BACKGROUND

In the resource recovery industry and fluid sequestration industry there is often need to create annular seals against radially outwardly disposed tubular structures. It is common to create such seals using a cone and an annular seal that is forced to climb the cone to an area having a larger diameter than where the annular seal started. This expands the annular seal into contact with the tubular structure. The art is always in need of improvements in tools it uses.

SUMMARY

An embodiment of an expandable annular seal tool including a cone having an actuation surface, a seal member disposed in the actuation surface, and an annular seal element disposed on the actuation surface.

An embodiment of a borehole system including a borehole in a subsurface formation, and a tool disposed in the borehole.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
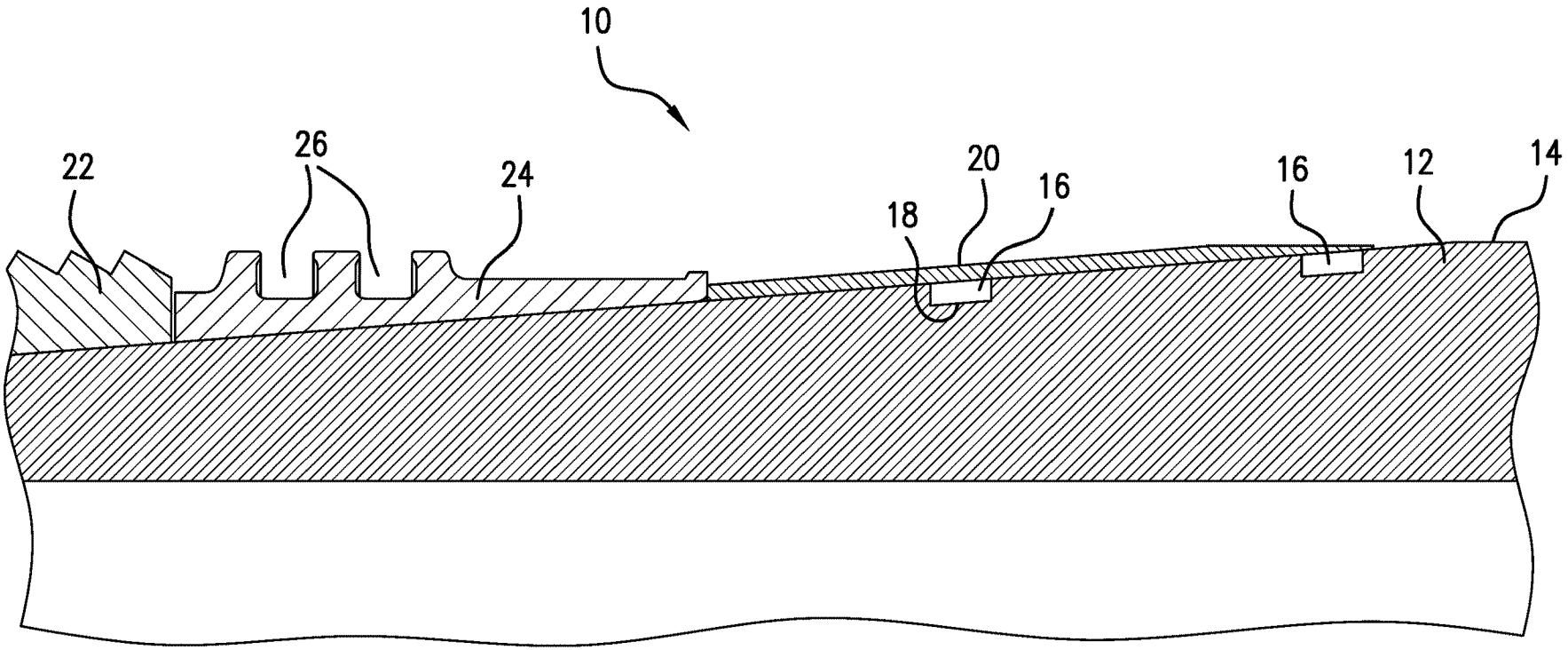
FIG. 1 is a cross sectional view of an annular seal tool as disclosed herein.
Figure 2:
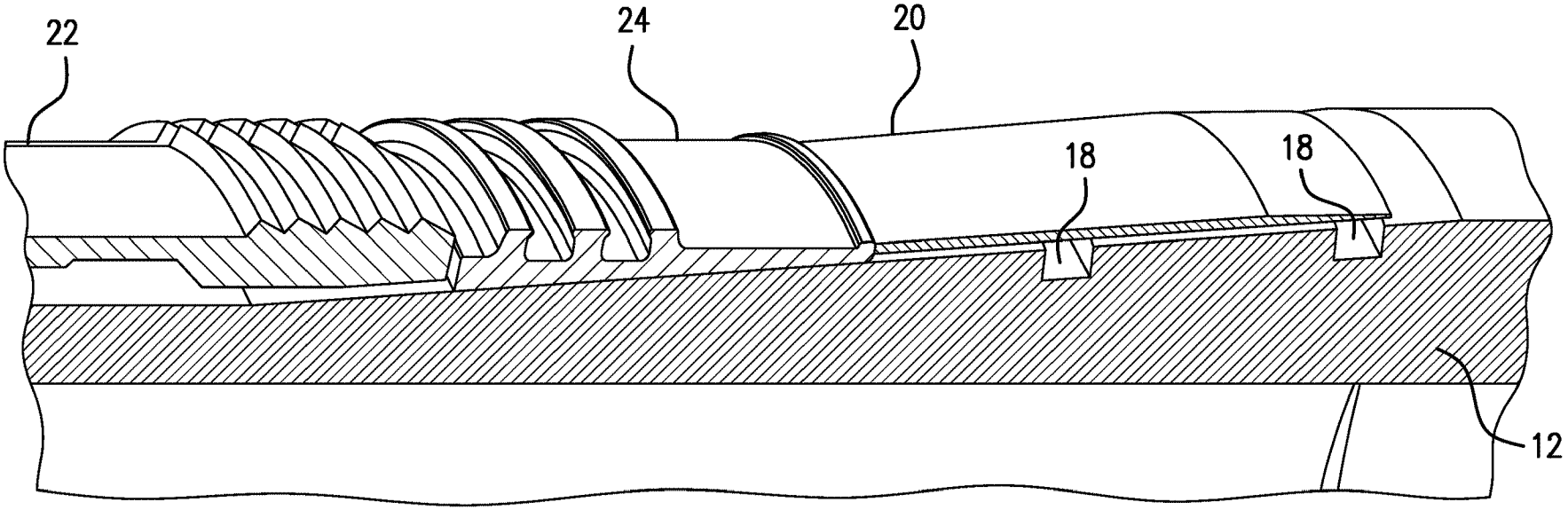
FIG. 2 is the same tool as claim 1 in a perspective cut away view.
Figure 3:
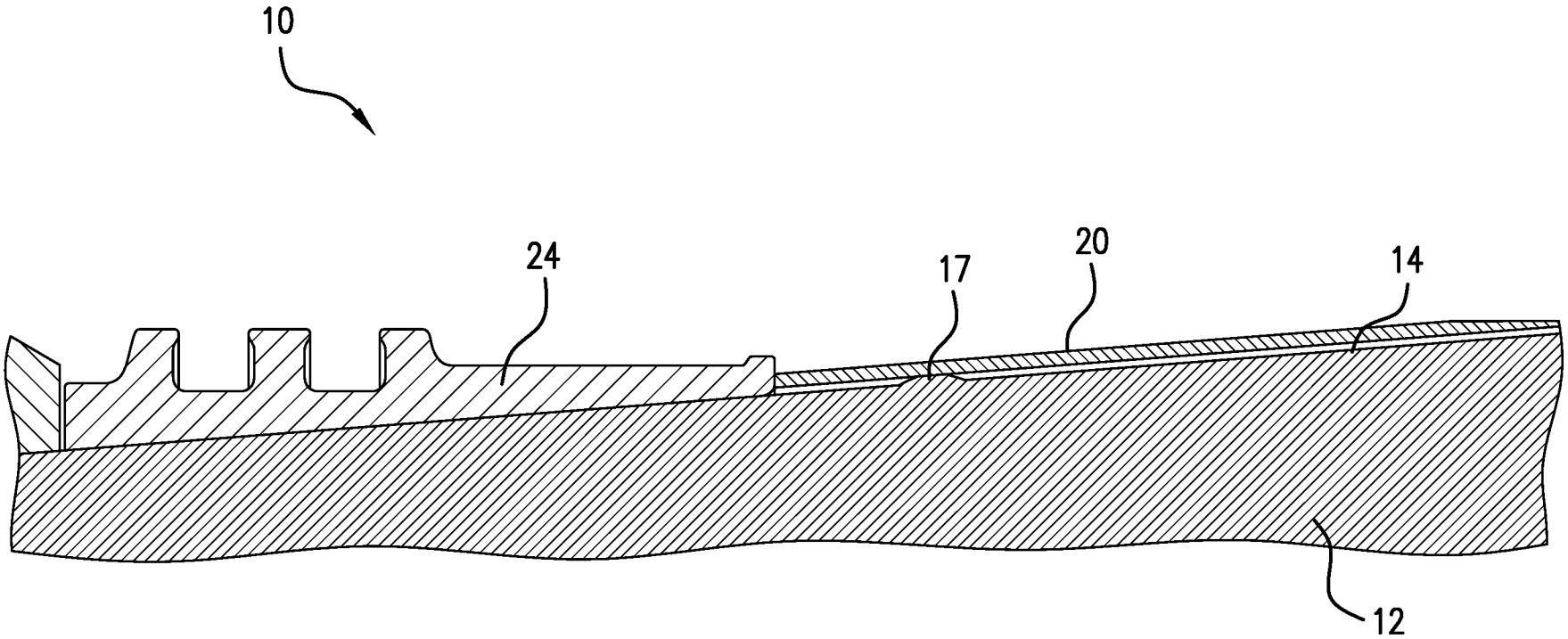
FIG. 3 is an alternate embodiment including a feature illustrated as a bump.

Referring to FIGS. 1 and 2, a tool 10 is illustrated. Tool 10 includes a cone 12 having an actuation surface 14. The actuation surface 14 includes a seal member 16 (two illustrated but one or more are contemplated with available space being the only limitation) that may be built into the cone 12 via for example an additive manufacturing process where the material deposited changes from that used for the cone to that used for the seal member. In another embodiment, referring to FIG. 3, the seal member 16 is a feature 17 configured as a bump machined into or onto the actuation surface 14 of the cone 12. The feature 17 creates a metal-to-metal seal with an annular seal element 24 that is disposed thereon when the tool 10 is in a set position. Alternatively, the seal member 16 may be disposed on the actuation surface by being placed in a recess 18 in the actuation surface 14. In an embodiment, the seal member 16 placed in the recess 18 is an o-ring or a bonded seal or equivalent sealing member.

Figure 4:
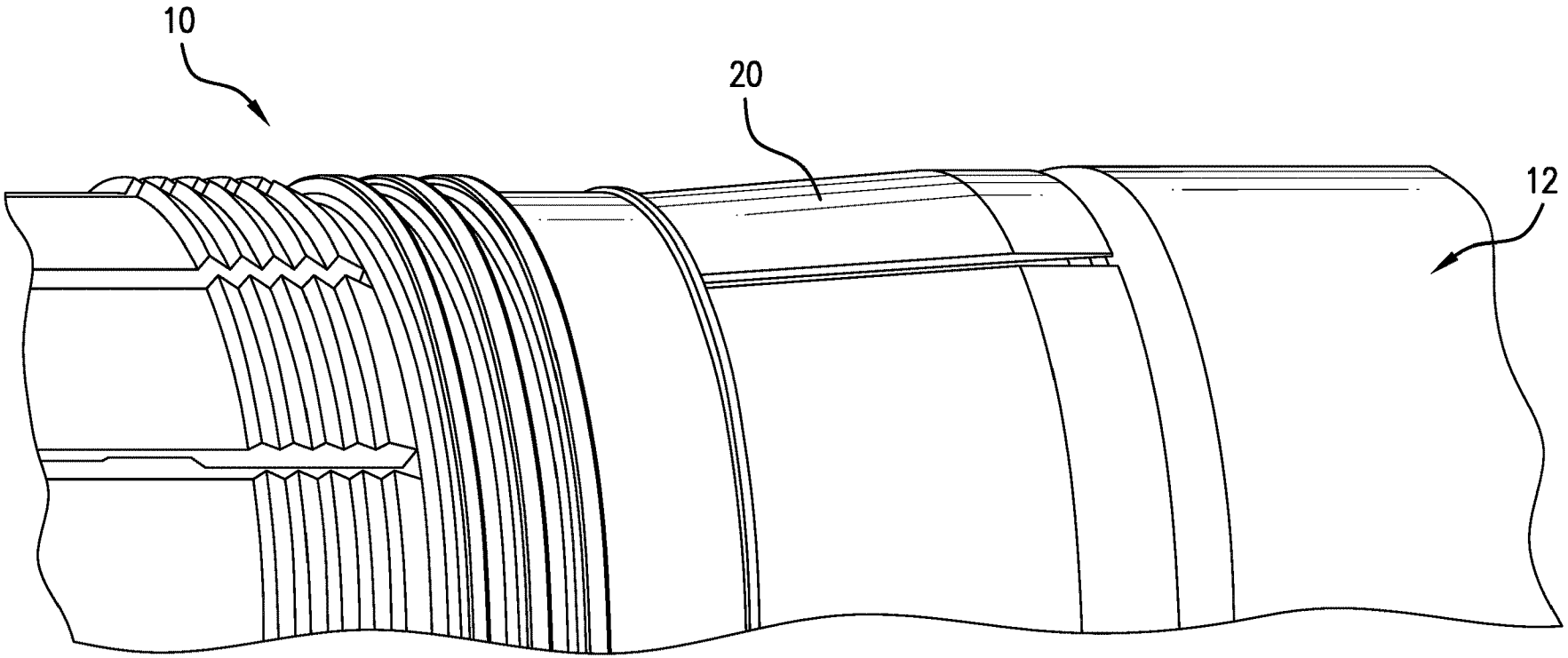
FIG. 4 illustrated the tool with a circumferentially incomplete protector.

In an embodiment, a protector 20 is disposed radially outwardly of the seal member 16 during run in. The protector 20 may be a split ring or a continuous ring but in either case, the protector 20 resides in a position that covers the seal member 16 or members 16 to protect them during run in and then will yield to mechanical or chemical input or temperature during setting of the tool 10. More specifically, in some embodiments, upon urging of the protector up the cone 12 to a larger diameter section of cone 12, the protector 20 will break apart and disperse or may simply stretch as it moves to the larger diameter portion of the cone 12. In other embodiments, the protector may be constructed of a material that is intentionally degradable such as a controlled electrolytic metallic material, a polyglycolic acid material, a wax or other material responsive to thermal decomposition, etc. It is to be understood that the protector 20 may be circumferentially complete, see FIG. 2, or circumferentially incomplete, see FIG. 4, in embodiments. The protector may also be a room temperature vulcanizing silicone, which is easily disrupted at setting pressures but will protect the seal member 16 during running.

In an embodiment, a slip 22 is also made a part of tool 10 to add anchoring capability.

Figure 5:
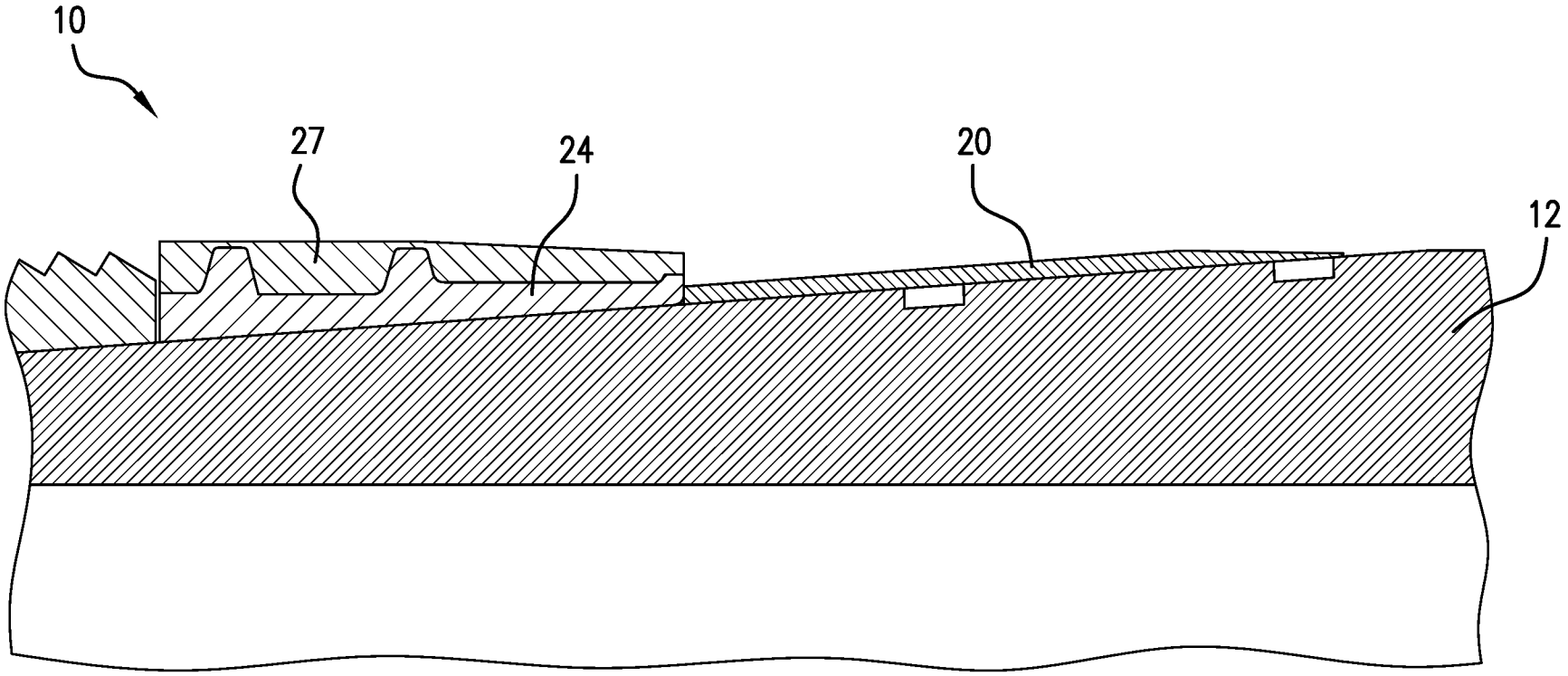
FIG. 5 is a view similar to FIG. 1 with a bonded annular seal.
Figure 6:
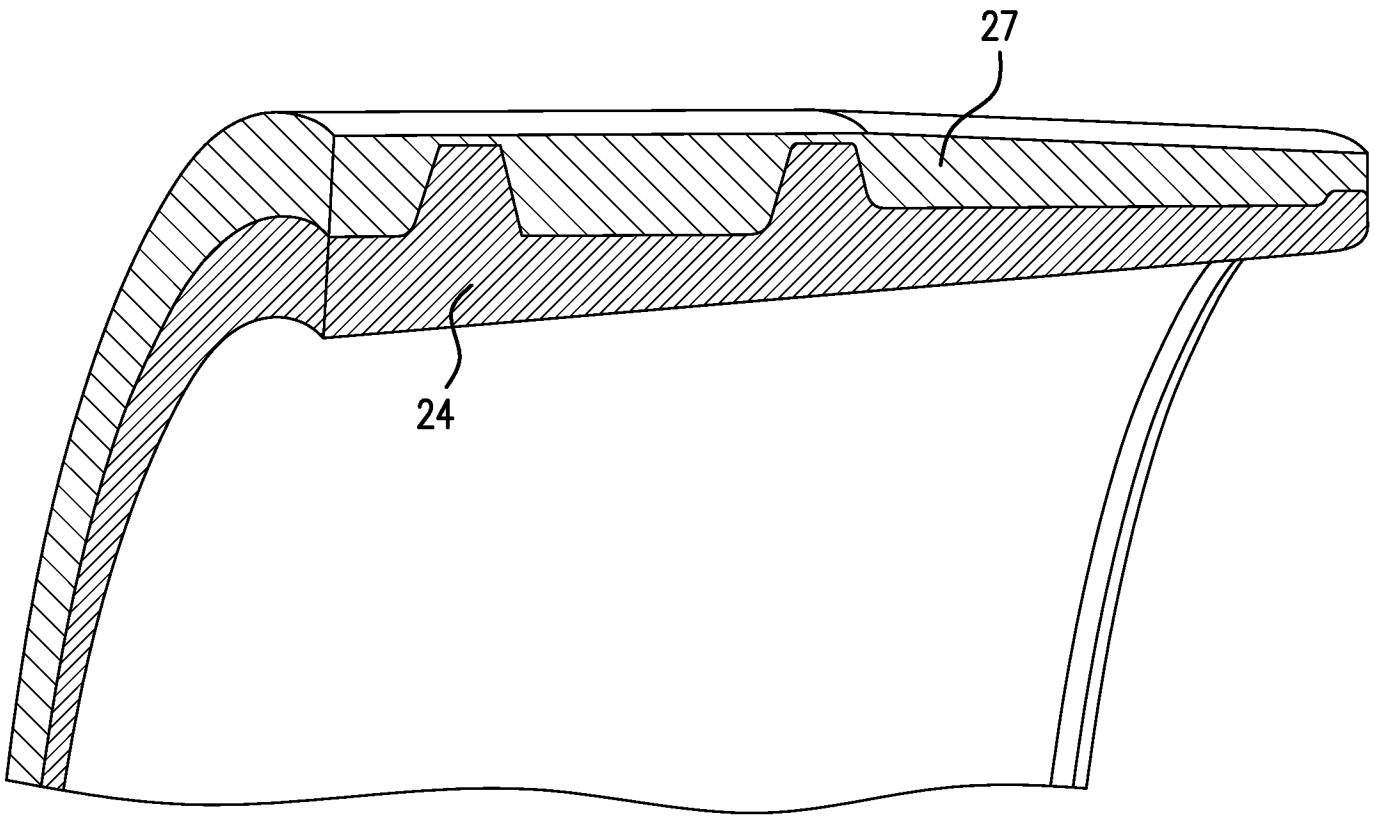
FIG. 6 is a perspective cutaway view of the bonded seal in FIG. 5.

In each embodiment, the annular seal element 24 is disposed about the cone 12. The element 24 may be a bonded seal or may be a carrier that holds its own O-rings in grooves 26 (as many o-rings or other types of seals such as bonded seals 27 (see for example FIGS. 5 and 6) or similar as can be physically fit along a longitudinal length of the annular seal element 24 are contemplated). In an embodiment, the element 24 may be configured as a metal-to-metal seal. T-seals, or similar are also contemplated. Other seals having the physical capability of expanding to a larger diameter on a cone and creating a seal with a tubular structure radially outwardly of the tool 10 are contemplated. The element 24 is expandable so that when forced to ride up the cone 12 to a larger diameter portion thereof, the element 24 will grow in diameter and will seal against a tubular structure radially outwardly disposed of the tool 10 such as a borehole wall (e.g. the borehole described below as 32) or a tubular (e.g. the tubular 38 described below) within which the tool 10 is run.

Figure 7:
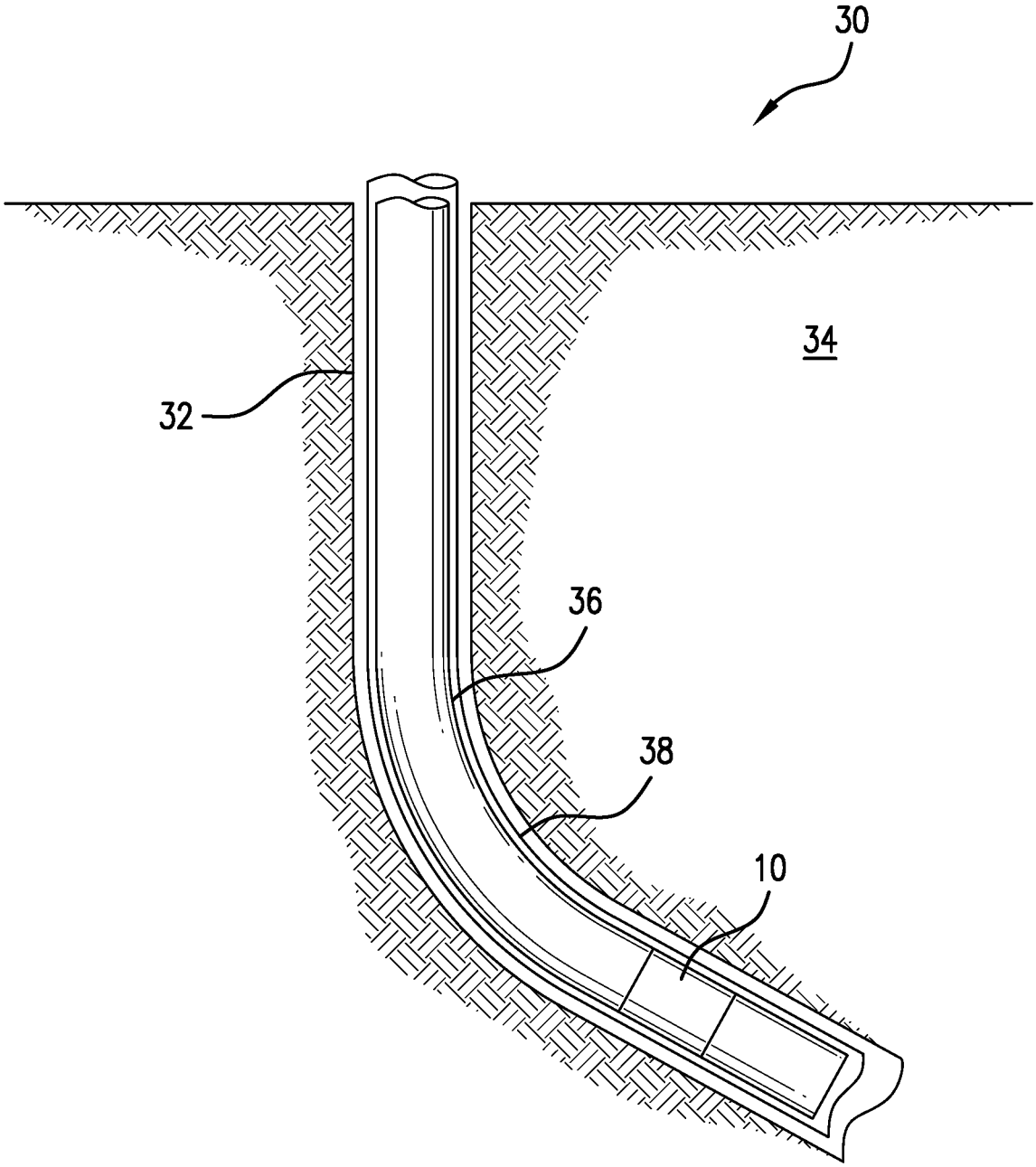
FIG. 7 is a view of a borehole system including annular seal tool as disclosed herein.

Referring to FIG. 7, a borehole system 30 is schematically illustrated. The system 30 comprises the borehole 32 in a subsurface formation 34. The tool 10 is disposed on string 36 which may be disposed within the borehole 32 alone or within the tubular 38 disposed in the borehole 32. In either case, the tool 10 will be run to depth as a part of the string 36.

Set forth below are some embodiments of the foregoing disclosure:

Embodiment 1: An expandable annular seal tool including a cone having an actuation surface, a seal member disposed in the actuation surface, and an annular seal element disposed on the actuation surface.

Embodiment 2: The tool as in any prior embodiment wherein the actuation surface includes a recess within which the seal member is disposed.

Embodiment 3: The tool as in any prior embodiment wherein the seal member is manufactured as a part of the actuation surface.

Embodiment 4: The tool as in any prior embodiment wherein the cone is additively manufactured.

Embodiment 5: The tool as in any prior embodiment wherein the cone is machined.

Embodiment 6: The tool as in any prior embodiment wherein the seal member is a metal-to-metal seal.

Embodiment 7: The tool as in any prior embodiment, further including a protector disposed radially outwardly of the seal member.

Embodiment 8: The tool as in any prior embodiment, wherein the protector is circumferentially complete.

Embodiment 9: The tool as in any prior embodiment, wherein the protector is circumferentially incomplete.

Embodiment 10: The tool as in any prior embodiment, wherein the protector is frangible on expansion.

Embodiment 11: The tool as in any prior embodiment, wherein the protector stretches on expansion.

Embodiment 12: The tool as in any prior embodiment, wherein the protector is formed of an intentionally degradable material.

Embodiment 13: The tool as in any prior embodiment, wherein the seal member is a plurality of seal members.

Embodiment 14: The tool as in any prior embodiment, wherein the seal member is an o-ring.

Embodiment 15: The tool as in any prior embodiment wherein the annular seal is a bonded seal.

Embodiment 16: The tool as in any prior embodiment, further including a slip.

Embodiment 17: A borehole system including a borehole in a subsurface formation, and a tool as in any prior embodiment disposed in the borehole.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" means within a range of ±8% of a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. An expandable annular seal tool comprising:

a cone having an actuation surface and a longitudinal axis;

a seal member disposed in the actuation surface;

an annular seal element disposed on the actuation surface having a first position longitudinally axially spaced from and not in physical contact with the seal member, the annular seal element being at a diametrically relatively smaller portion of the cone and a second position of the annular seal element moved to a diametrically relatively larger portion of the cone radially outwardly of the seal member, covering the seal member, and forming a seal between the annular seal element and the seal member, and a protector having a first position radially outwardly covering the seal member and a second position where the protector is displaced and not covering the seal member.

2. The tool as claimed in claim 1 wherein the actuation surface includes a recess within which the seal member is disposed.

3. The tool as claimed in claim 1 wherein the seal member is manufactured as a part of the actuation surface.

4. The tool as claimed in claim 1 wherein the cone is additively manufactured.

5. The tool as claimed in claim 1 wherein the cone is machined.

6. The tool as claimed in claim 1 wherein the seal member is a metal-to-metal seal.

7. The tool as claimed in claim 1, wherein the protector is circumferentially complete.

8. The tool as claimed in claim 1, wherein the protector is circumferentially incomplete.

9. The tool as claimed in claim 1, wherein the protector is frangible on expansion.

10. The tool as claimed in claim 1, wherein the protector stretches on expansion.

11. The tool as claimed in claim 1, wherein the protector is formed of an intentionally degradable material.

12. The tool as claimed in claim 1, wherein the seal member is a plurality of seal members.

13. The tool as claimed in claim 1, wherein the seal member is an o-ring.

14. The tool as claimed in claim 1 wherein the annular seal is a bonded seal.

15. The tool as claimed in claim 1, further including a slip.

16. A borehole system comprising:

a borehole in a subsurface formation; and a tool as claimed in claim 1 disposed in the borehole.

* * * * *